US005483738A

United States Patent [19]

Watanabe et al.

[11] Patent Number: 5,483,738

[45] Date of Patent: Jan. 16, 1996

[54] APPARATUS FOR MAKING ELECTRICAL HARNESS HAVING WIRE MEASURING APPARATUS EQUIPPED WITH ANTI-CURLING MEANS

[75] Inventors: Souichi Watanabe, Yokohama; Sadao Takahashi, Machida; Kazuaki Kamei, Yamato, all of Japan

[73] Assignee: Molex Incorporated, Lisle, Ill.

[21] Appl. No.: 213,656

[22] Filed: Mar. 15, 1994

[30] Foreign Application Priority Data

Apr. 12, 1993 [JP] Japan ..... 5-024157 U

[51] Int. Cl.[6] ..... H01R 43/28

[52] U.S. Cl. ..... 29/748; 29/33 F

[58] Field of Search ..... 29/33 F, 566.2, 29/748, 749; 140/102; 226/113, 114, 119

[56] References Cited

U.S. PATENT DOCUMENTS

| | | | |
|---|---|---|---|
| 4,235,015 | 11/1980 | Funcik et al. | 29/749 X |
| 4,333,230 | 6/1982 | Funcik et al. | 29/749 |
| 4,352,227 | 10/1982 | Ogata et al. | 29/33 F |
| 5,230,147 | 7/1993 | Asaoka et al. | 29/748 X |
| 5,282,311 | 2/1994 | Tamura | 29/33 F X |

FOREIGN PATENT DOCUMENTS

| | | | |
|---|---|---|---|
| 000428 | 1/1979 | European Pat. Off. | 29/748 |
| 130743 | 1/1985 | European Pat. Off. | 29/748 |
| 601474 | 6/1994 | European Pat. Off. | 29/33 F |
| 1790108 | 1/1972 | Germany . | |
| 549298 | 5/1974 | Switzerland . | |

*Primary Examiner*—Peter Vo
*Attorney, Agent, or Firm*—Charles S. Cohen

[57] ABSTRACT

Disclosed is an improved wire measuring apparatus comprising a wire guide roller mechanism 3 and a looper 5 to push down a fed wire to a descending position, thereby measuring the length of wire in terms of descending position at which the wire is held by the looper 5. The wire guide roller mechanism 3 comprises a frame, first, second and third guide rollers 6, 7 and 8 rotatably fixed to the frame. The first and third guide rollers 6 and 8 rotate in same direction, and the second guide roller 7 rotates in an opposite direction both in pulling the wire forward and backward. Also, the whole guide roller arrangement is designed to incline and follow the increasing or decreasing inclination of wire length ahead of the third guide roller. Thus, the wire curling inclination can be reduced from the measured wire. The second guide roller acts to reduce the effect of the wires bending around the first guide roller and the wires extend tangentially from the third guide roller.

9 Claims, 7 Drawing Sheets

APPARATUS FOR MAKING ELECTRICAL HARNESS HAVING WIRE MEASURING APPARATUS EQUIPPED WITH ANTI-CURLING MEANS

FIELD OF THE INVENTION

The present invention relates to a wire measuring apparatus equipped with anti-curling means, which apparatus is used for manufacturing electric harnesses each comprising an electric connector crimped to one or either end of a length of wire.

BACKGROUND OF THE INVENTION

As is well known, electric harnesses each comprising wires of predetermined lengths with electric connectors crimped to their ends are widely used to make electric connection between electric devices. Such electric harnesses have a variety of wire lengths to meet different applications. In this connection electric harness producing machines are designed to crimp electric connectors to one or both ends of wires, and are designed to measure different lengths of wire.

FIGS. 11 and 12 show how the wire measuring part of a conventional electric harness producing machine measures wire length. Specifically, a length of wire W is pulled out of a wire supply reel (not shown) through a wire guide roller mechanism 40, and the wire W is caught and pushed down by the roller 42 of a looper 41 against the tension of the stretched wire W as indicated by arrow. The wire length W is determined in terms of the position at which the descending looper 41 holds the wire W with its roller 42.

The wire guide roller mechanism 40 comprises a single roller to permit the guiding of a plurality of parallel wires, and is designed to rotate at a fixed position relative to the wire supply reel. In FIGS. 11 and 12 means for conveying electric connectors R is indicated at 43.

The conventional wire measuring system can measure wire lengths easily, but it has the following deficiencies: when the looper 41 is raised subsequent to termination of measurement as shown in FIG. 12, and when the wire W thus measured is released from tension, the part of wire W which was stretched by the descending looper 41 so it extends from the roller 42 of the looper 41 to the wire guide roller mechanism 40 in FIG. 11, is curled as indicated by K in FIG. 12. The curled part of the wire length is liable to interfere the rising of the looper 41, and when a plurality of wires are measured, these individual wires are liable to tangle. Accordingly, the efficiency with which wire measuring and crimping can be carried out is lowered. The cause of curling is: when the roller 42 of the looper 41 is lowered, the wire W is pulled over the curved surface of the wire guide roller 40, which rotates at a fixed position, thus forming an angle between the upstream and downstream wire lengths relative to the wire guide roller 40. This causes curling of the downstream wire length upon putting the wire in a stress-free condition upon, raising the looper 41.

SUMMARY OF THE INVENTION

One object of the present invention is to provide a wire measuring apparatus which reduces curling of the wire length on the downstream side of the wire guide roller upon termination of wire measurement, and thus reducing the possibility of wire tangling and interfering with the raising of the looper. This accordingly improves the efficiency with which measuring and crimping can be effected.

To attain this object, a wire measuring apparatus is provided comprising a wire guide roller mechanism downstream of a wire supply reel, a looper having a roller and means for raising and lowering said looper to thereby permit the measuring of a length of wire drawn from the wire supply reel in terms of the descending position at which the wire is pushed down and held by the roller of the looper against the tension of the stretched wire. An improvement according to the present invention is that the wire guide roller mechanism comprises a frame; a first guide roller rotatably fixed to said frame and permitted to rotate in a first direction during the feeding of the wire; a second guide roller rotatably fixed to said frame downstream of said first guide roller and permitted to rotate in a second or reverse direction during the feeding of the wire; a third guide roller rotatably fixed to said frame downstream of said second guide roller and permitted to rotate in the first direction, thus permitting withdrawal of the wire; and means to permit the second and third guide rollers to rotate about the rotating center of said first guide roller, thus causing the whole guide roller arrangement to incline as the part of wire fed out of the wire guide roller mechanism inclines, thereby preventing undesired curling of the wire.

With this arrangement the first guide roller is permitted to rotate in one direction during the descending of the looper, thereby guiding the wire. The wire will come to have a curling inclination due to bending over the first guide roller. The wire, however, will lose such curling inclination by the second guide roller, which rotates in the other or reverse direction.

Likewise, after termination of measurement to permit the rising of the looper the second guide roller rotates in the other direction as the wire is withdrawn, thus causing the wire to have a curling inclination. The wire, however, will lose such curling inclination by the third guide roller, rotating in the direction opposite to the direction in which the second roller 7 rotates.

The second and third guide rollers are permitted to rotate about the rotating center of the first guide roller, thus causing the whole guide roller arrangement to incline and follow the inclining of the wire length between the third guide roller and the roller of the looper, preventing the wire from bending over the curved surface of the third guide roller. Therefore, no curling inclination appears in the measured wire length.

BRIEF DESCRIPTION OF THE DRAWINGS

Other objects and advantages of the present invention will be understood from the following description of a preferred embodiment of the present invention, which is shown in accompanying drawings.

DETAILED DESCRIPTION OF THE PREFERRED EMBODIMENT

Figure 1:
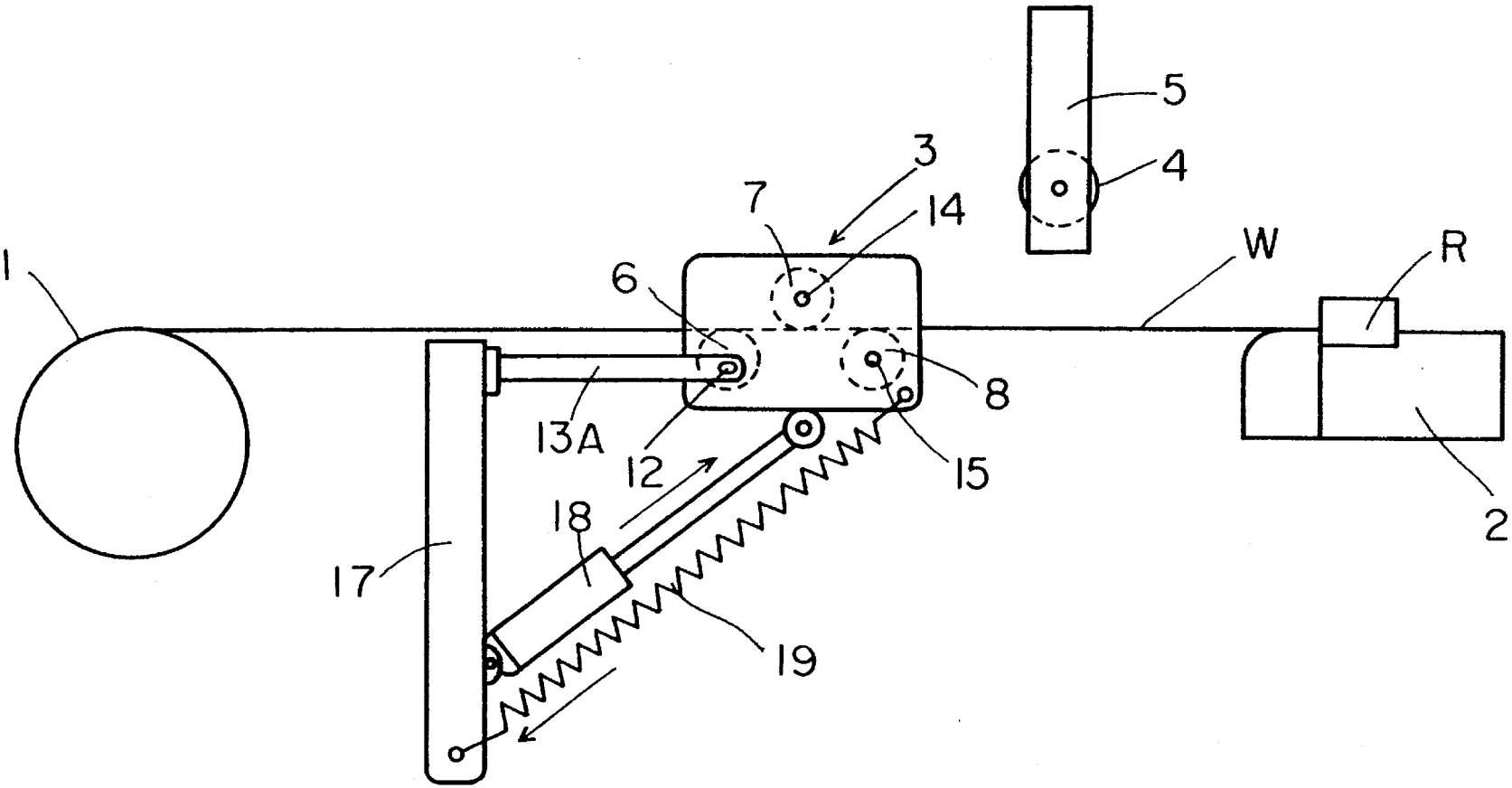
FIG. 1 shows a schematic representation of a wire measuring apparatus according to the present invention prior to the start of wire measurement.

FIGS. 1 to 10 show a wire measuring apparatus according to a preferred embodiment of the present invention. As shown in FIG. 1, the wire measuring apparatus comprises a wire guide roller mechanism 3 downstream of a wire supply reel 1, a looper 5 having a roller 4 and means 2 for carrying electric connectors R.

The wire supply reel 1 comprises a plurality of subreels or individual reels laterally arranged at regular intervals for supplying the plurality of wires W. Likewise, the roller 4 of the looper 5 has a plurality of grooves laterally arranged at regular intervals for guiding the plurality of wires W.

The wire guide roller mechanism 3 comprises a frame, a first guide roller 6 rotatably fixed to the frame, a second guide roller 7 rotatably fixed to the frame downstream of the first guide roller 6 and a third guide roller 8 rotatably fixed to the frame downstream of the second guide roller 7. The first and third guide rollers 6 and 8 are arranged on the lower surface of the fed wires W whereas the second guide roller 7 is arranged on the upper surface of the fed wires W. These guide rollers 6, 7 and 8 are initially arranged so as to permit the fed wires to extend horizontally or straight between the supply reel 1 and connectors R.

Figure 2:
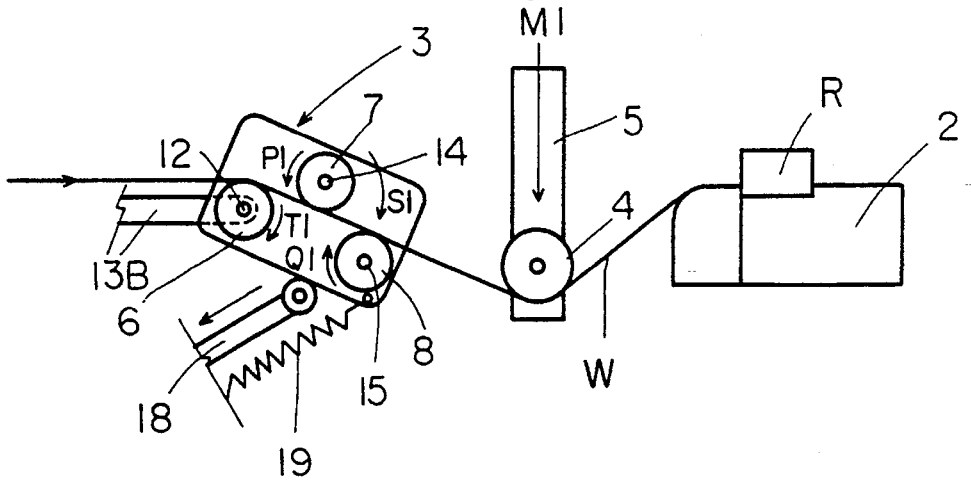
FIG. 2 shows the wire measuring apparatus of FIG. 1 in the condition in which the wire measurement starts.
Figure 3:
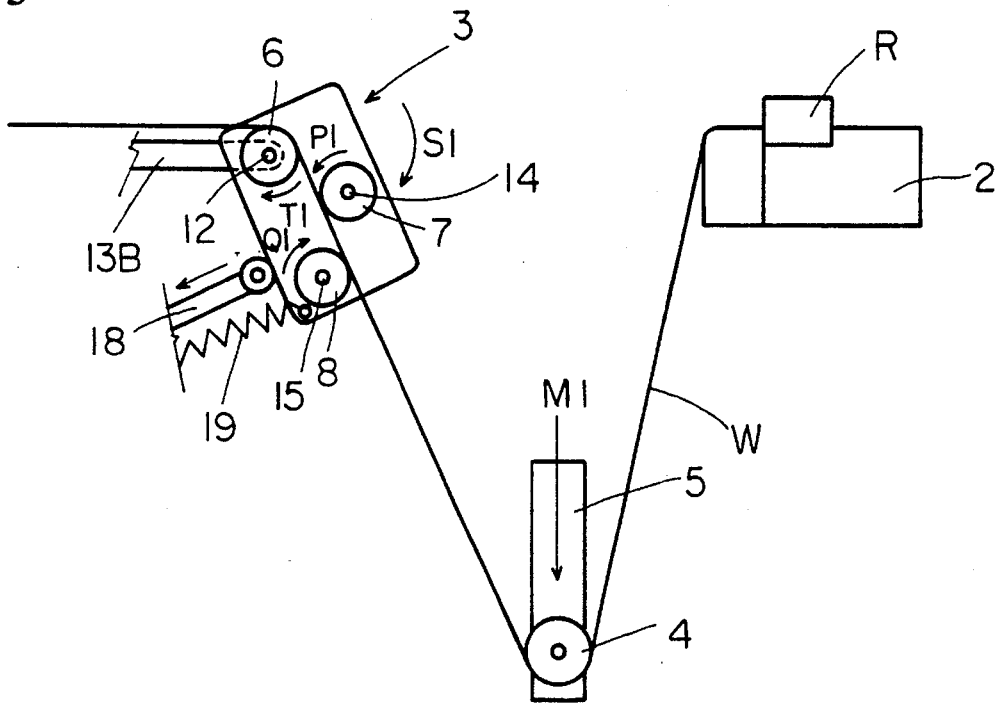
FIG. 3 shows the wire measuring apparatus of FIG. 2 in the condition in which its looper is lowered to the lowest position to determine a longest wire length.
Figure 4:
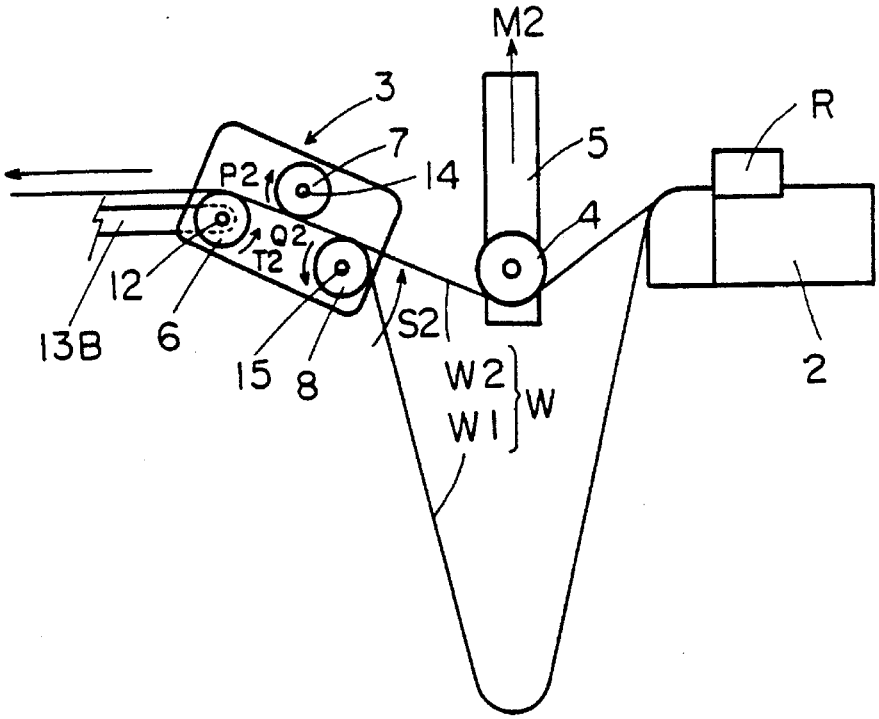
FIG. 4 shows the wire measuring apparatus of FIG. 2 in the condition in which the looper is raised to measure a second longest wire length, leaving the longest wire length just measured behind in the lowest position.
Figure 5:
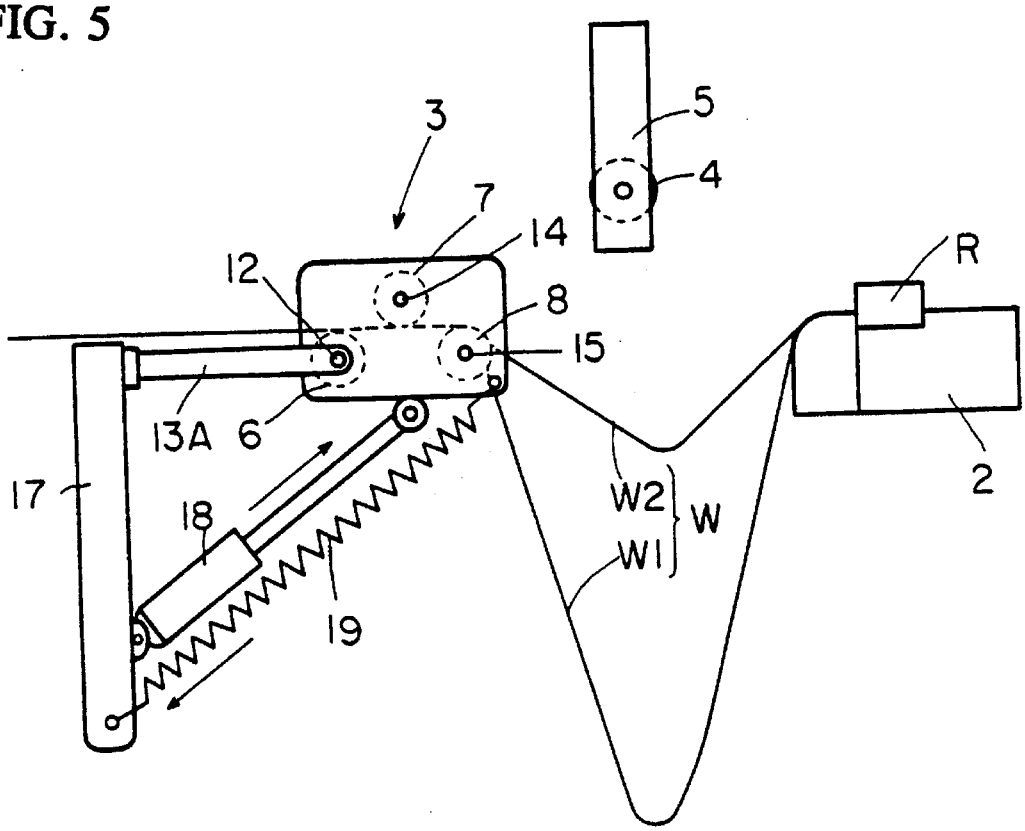
FIG. 5 shows the wire measuring apparatus of FIG. 2 in the condition in which the looper returns to its starting position, leaving the second longest wire length just measured behind in the second lowest position.

When the wires W are fed from the wire supply reel 1 by moving looper 5 downward as shown in FIGS. 2 and 3, the first guide roller 6 and the third guide roller 8 rotate clockwise as indicated by arrows T1 and Q1 respectively, and the second guide roller 7 rotates counterclockwise as indicated by arrow P1. When the wires W are pulled back toward the wire supply reel 1 as shown in FIGS. 4 and 5, the first guide roller 6 and the third guide roller 8 rotate counterclockwise as indicated by arrows T2 and Q2, and the second guide roller 7 rotates clockwise as indicated by arrow P1.

These guide rollers 6, 7 and 8 are pivoted about axles 12, 14 and 15, and the whole guide roller arrangement is adapted to rotate about the pivot axle 12 of the first guide roller 6. As the downstream length of wires W is increased, the guide roller arrangement is increasingly pulled downward by the third guide roller 8 at an increasingly inclining angle.

The whole guide roller arrangement is shown in more detail in FIGS. 7, 8, 9 and 10. The first, second and third guide rollers 6, 7 and 8 are pivotally mounted by their axles 12, 14 and 15 to a frame, which comprises a pair of side plates 9 and 10 and a bottom plate 11. Each guide roller has a plurality of grooves 16 at regular intervals to guide the corresponding plurality of wires. The pivot axle 12 of the first guide roller 6 is further supported by support arms 13A and 13B, which in turn, are supported by a base plate 17 (see FIG. 1). Thus, the whole guide roller arrangement can be rotated about the pivot axle 12 of the first guide roller 6. In order to permit inclination of the whole guide roller arrangement to follow the inclination of the wire length extending ahead of the third guide roller 8, a spring 19 is used to apply a resilient force to cause the whole frame to rotate clockwise in FIG. 1, and a cylinder-and-piston drive 18 is used to apply a force to cause the whole frame to rotate counterclockwise. Withdrawal of the piston in the cylinder will cause the whole guide roller arrangement to rotate and incline in unison with the inclination of the wire length extending ahead of the third guide roller 8.

Although not shown in FIGS. 1–5, FIG. 7 clearly shows that rollers 6, 7 and 8 are positioned so that wires W curve slightly around roller 7. In other words, the wires W would extend in a straight line tangential to rollers 6 and 8 except that roller 7 is positioned downward slightly into the path of wires W between the rollers 6 and 8. By causing the wires W to slightly curve around roller 7, it has been found that the effect of the wire curving around roller 6 is reduced which reduces twisting of the wires W. It has been found that the distance roller 7 must be moved into the path of wires W may be a small as the thickness of the wires.

It is understood that the guide roller bearing mechanism and the guide roller inclining mechanism may be modified to meet particular applications.

In operation, as shown in FIG. 1, a plurality of wires W having electric connector R crimped at their right ends, are fed by pulling their electric connector R rightward by the electric connector conveying means 2. At this time, the looper 5 is in its raised position, and the guide roller arrangement 3 remains horizontal as the fed wire W extend horizontal.

As shown in FIG. 2, the looper 5 is lowered to feed or push the wires W down with its roller 4 as indicated by arrow M1, thus starting the measuring of the wires. This causes the wires W to be pulled out from the wire supply 1. Accordingly, the first guide roller 6 is rotated clockwise as indicated by arrow T1. At the same time, the second guide roller 7 is rotated counterclockwise as indicated by arrow P1, and the third guide roller 8 is rotated clockwise as indicated by arrow Q1. The piston is withdrawn in the cylinder 18 to permit rotation and inclination of the whole guide roller arrangement about the pivot axle 12 of the first guide roller 6 to follow the wire inclination as indicated by arrow S1 in FIG. 3. Therefore, the wire length extending ahead of the third guide roller 8 does not bend in conformity with the curved surface of the third guide roller 8 but rather extends tangentially from roller 8.

The fed wire length is bent over the first guide roller 6 so that the fed wire length has come to have a curling inclination. Such curling inclination, however, will be removed by the counterclockwise rotation of the second guide roller 7.

FIG. 3 shows the measuring of the longest wire length by lowering the looper 5 to the corresponding lowest level as indicated by arrow M1. In this situation the first and third guide rollers 6 and 8 rotate clockwise as indicated by arrows T1 and Q1, and the second guide roller 7 rotates counterclockwise as indicated by arrow P1. At the same time, the whole guide roller arrangement 3 is inclined to follow the inclination of the fed pulled-out length of wires. Thus, the wires W are guaranteed free of curling inclination.

In FIG. 4, selected wires of the longest length W1 are clamped, and then the looper 5 is raised as indicated by arrow M2 so as to measure selected wires W2 for a second longest length. These selected wires W2 are pulled back by the wire supply reel 1. Accordingly, the third and first guide rollers 8 and 6 rotate counterclockwise as indicated by arrows Q2 and T2, and the second guide roller 7 rotates clockwise as indicated by arrow P2. Any wire-curling inclination caused by the third guide roller 8 will be canceled by the second guide roller 7. The whole guide roller arrangement inclines to follow the decreasing inclination of the wires W2 as indicated by arrow S2. The longest wires W1 already measured are clamped by clamping means (not shown), suspended by gravity in stress-free condition.

Figure 6:
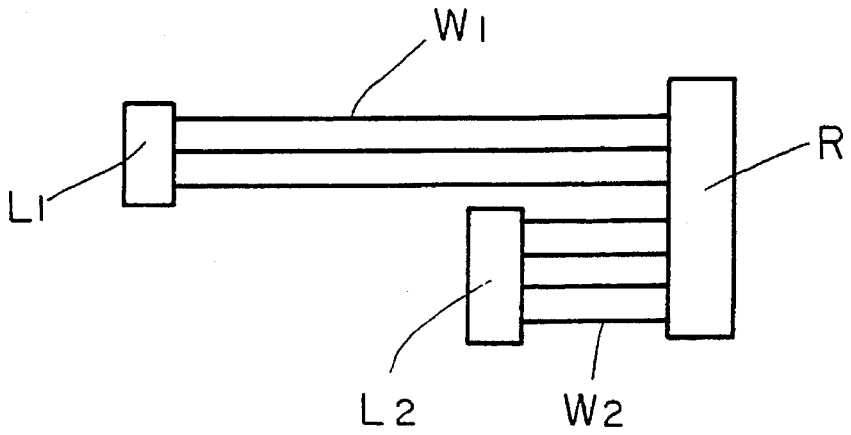
FIG. 6 shows an electric harness with wires of different lengths.
Figure 7:
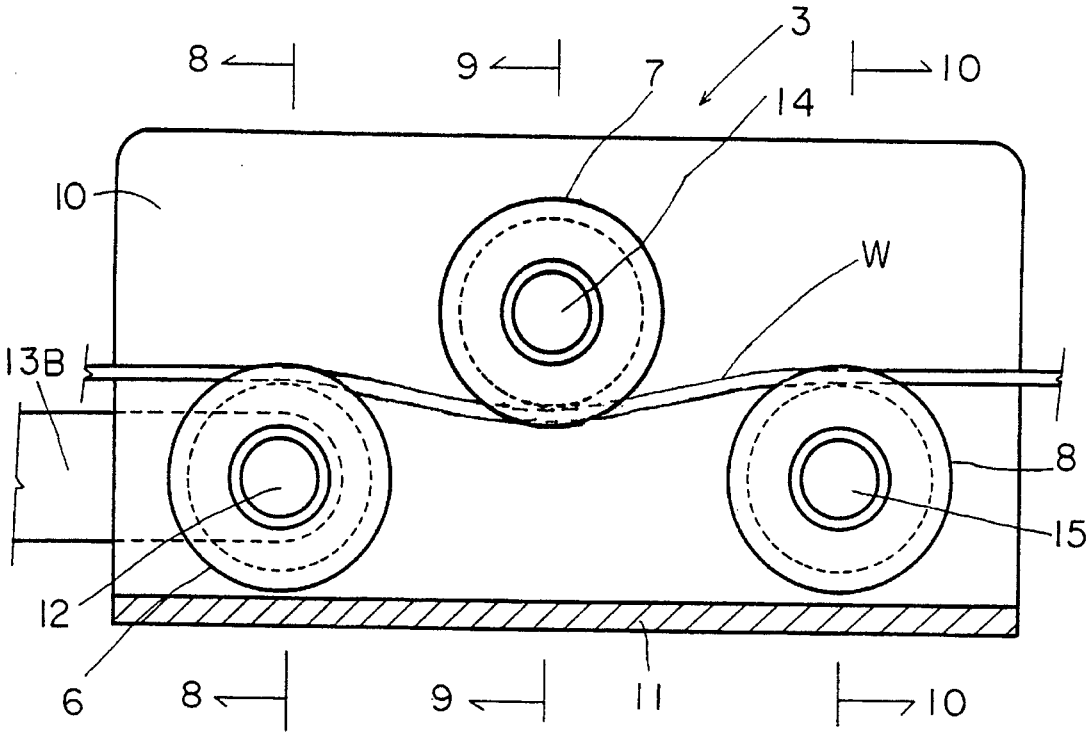
FIG. 7 is a longitudinal section of a wire guide roller mechanism taken along the line 7—7 in FIG. 8.
Figure 8:
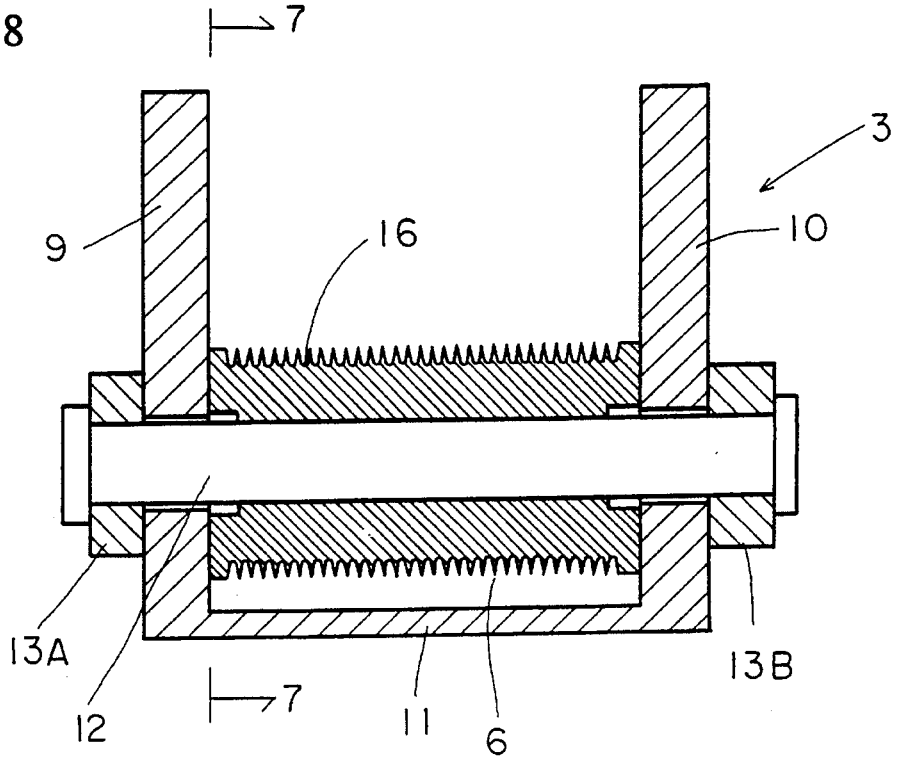
FIG. 8 is a cross section of the wire guide roller mechanism taken along the line 8—8 in FIG. 7.
Figure 9:
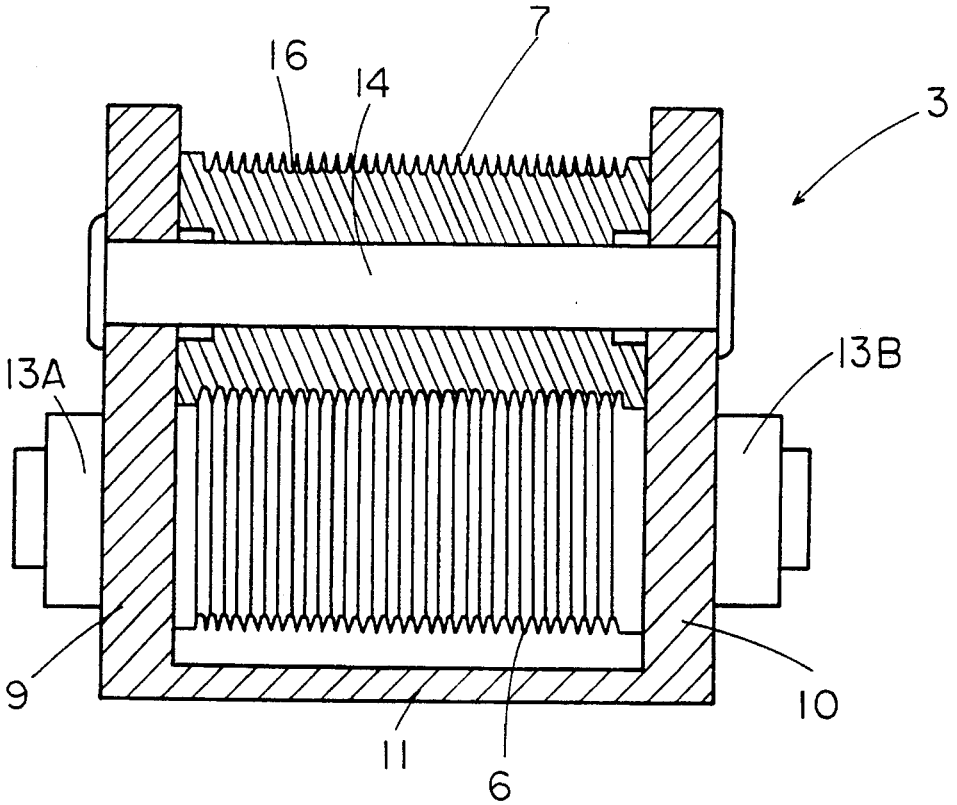
FIG. 9 is a cross section of the wire guide roller mechanism taken along the line 9—9 in FIG. 7.
Figure 10:
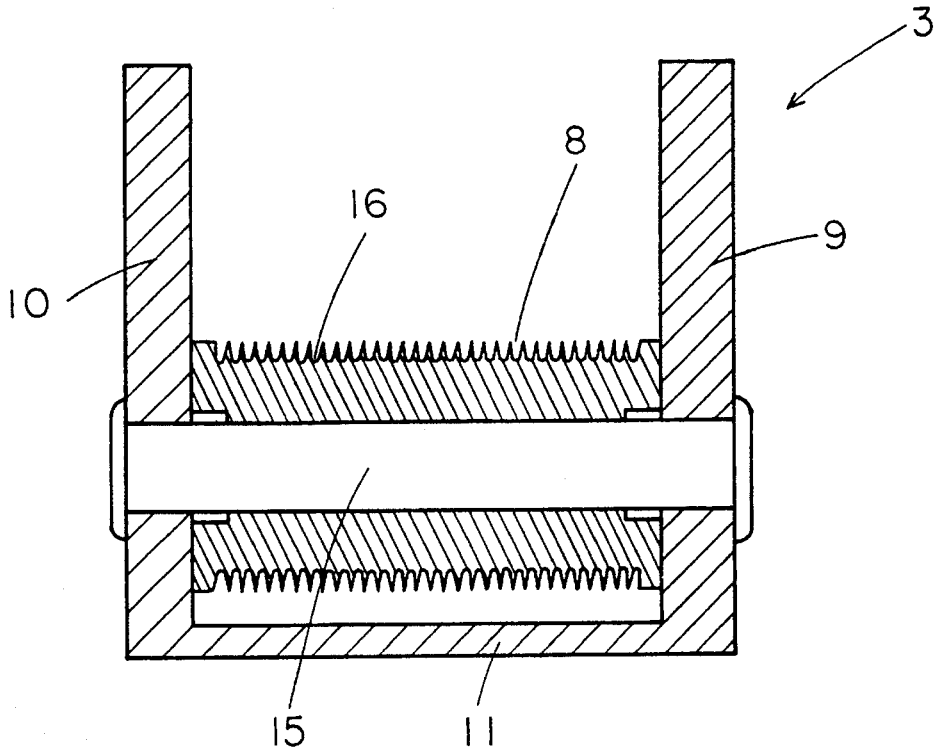
FIG. 10 is a cross section of the wire guide roller mechanism taken along the line 10—10 in FIG. 7.
Figure 11:
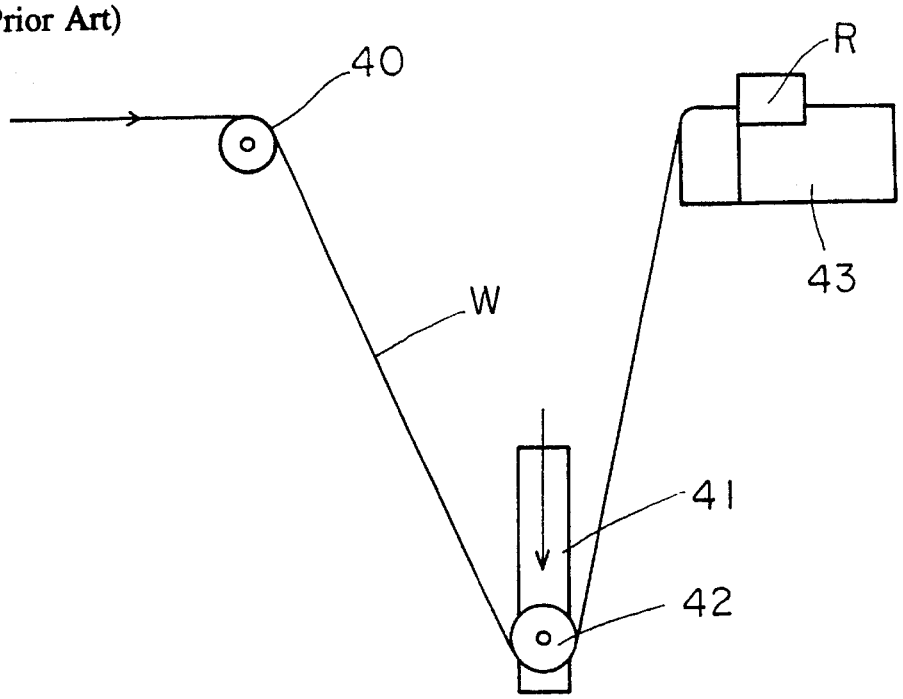
FIG. 11 (Prior Art)
FIG. 11 shows a conventional wire measuring apparatus in the condition in which its looper is lowered to measure the wire.
Figure 12:
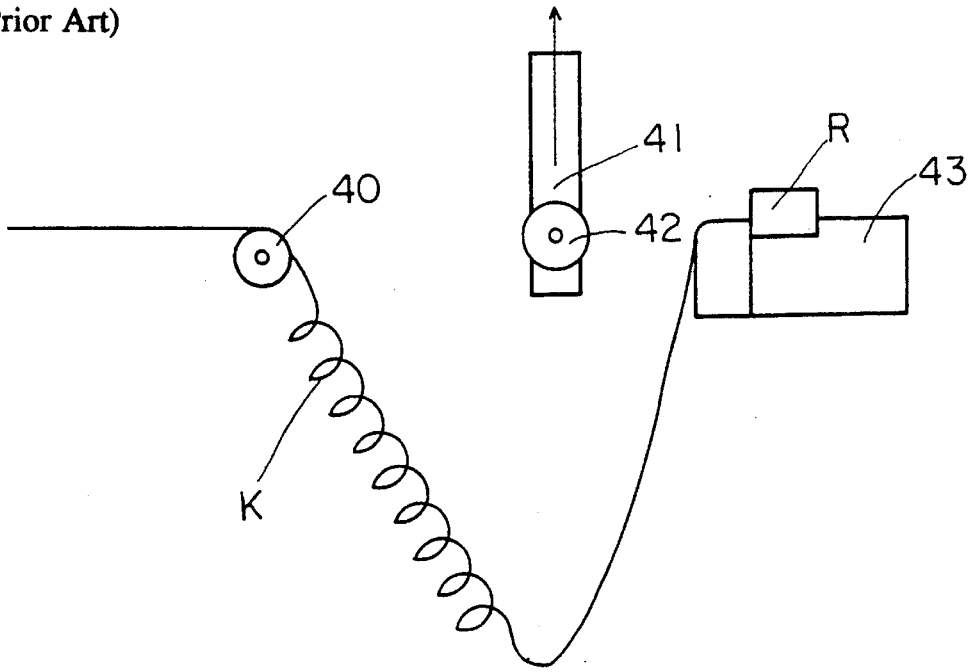
FIG. 12 (Prior Art)
FIG. 12 shows a conventional wire measuring apparatus in the condition in which its looper is raised to put the wire in a stress-free condition, thereby permitting the curling of the wire.

In FIG. 5, the measuring of the longest and second longest wires W1 and W2 is finished, and the looper 5 returns to its original position. Then, electric connectors L1 and L2 are crimped to the left ends of these wires W1 and W2 to provide an electric harness as shown in FIG. 6. Such an electric harness is free of curling inclination.

This particular example of electric harness is described as comprising a plurality of wires of different lengths with electric connectors attached to both ends. Electric harnesses, however, may comprise a single wire having an electric connector attached to one end, the other end being stripped and exposed, or may comprise a single wire with electric connectors attached to both ends. Also, a plurality of wires of same length with an electric connector attached to one end thereof or with electric connectors attached to both ends thereof.

We claim:

1. In an apparatus for making an electrical harness having a plurality of wires and at least one electrical connector at a first end of said plurality of wires, said apparatus comprising:

an apparatus for supplying a plurality of wires along a first path;

means for supporting an electrical connector;

means for guiding said wires between said wire supplying apparatus and said electrical connector;

looper means movable along a second path at an angle to said first path and including a wire engaging surface adjacent a bottom portion of said looper means to engage said wires in order to move a portion of said wires generally along said second path;

said guiding means including a wire anti-curling section immediately adjacent said looper means, said wire anti-curling means having a first curved surface against which said wires are pulled upon moving said looper means along said second path;

said wire anti-curling section also includes second and third curved surfaces against which said wires engage upon moving said looper means along said second path, said first and second curved surfaces being located on opposite sides of said wires, said first and third curved surfaces being located on the same side of said wires and said first, second and third curved surfaces being located upstream of said looper means and being located at a transition region between said first and second paths, said wires engaging both said first and second curved surfaces about an arcuate length of said first and second curved surfaces; and said second and third curved surfaces are mounted to a frame and said frame is rotatably mounted about an axis generally located at the center of curvature of said first curved surface.

2. An apparatus as set forth in claim 1 wherein at least one of said curved surfaces is a rotatable roller.

3. An apparatus as set forth in claim 1 wherein at least one of said curved surfaces is a roller rotatably mounted to said frame.

4. An apparatus as set forth in claim 1 wherein the portion of said second curved surface that engages said wires is located between said wires and a plane tangential to both said first and third curved surfaces at their contact areas with said wires.

5. An apparatus as set forth in claim 1 wherein said first, second and third curved surfaces are rotatable rollers, each having an axis of rotation, and said second and third rollers also being mounted to means for rotating said second and third rollers about the axis of rotation of the first roller, whereby said second and third rollers rotate about their own axes and the axis of rotation of the first roller as said looper means moves along said second path.

6. An apparatus as set forth in claim 5 wherein said means for rotating includes a guide roller frame upon which said second and third rollers are rotatably mounted, said guide roller frame being rotatable about the axis of rotation of the first roller, and means for rotating said guide roller frame about the axis of rotation of the first roller.

7. In an apparatus for making an electrical harness having a plurality of wires and at least one electrical connector at a first end of said plurality of wires, said apparatus comprising:

an apparatus for supplying a plurality of wires along a first path;

means for supporting an electrical connector;

looper means movable along a second path at an angle to said first path and including a wire engaging surface to engage said wires in order to move a portion of said wires generally along said second path to increase a length of wire between said wire supplying apparatus and said electrical connector;

a first roller positioned in said first path for guiding said wires between said wire supplying apparatus and said electrical connector and against which said wires are pulled upon moving said looper means along said second path;

a second roller adjacent said first roller and against which said wires are pulled upon moving said looper means along said second path, said first and second rollers being located on opposite sides of said wires and said first and second rollers being located upstream of said looper means, said wires engaging both said first and second rollers about an arcuate length thereof;

a third roller against which said wires are pulled upon moving said looper means along said second path, said first and third rollers being located on the same side of said wires; said first, second and third rollers being located on the same side of said first path relative to said looper means and being located at a transition region between said first and second paths; and said first, second and third rollers each have an axis of rotation, and said second and third rollers are also mounted to means for rotating said second and third rollers about the axis of rotation of the first roller, whereby said second and third rollers rotate about their own axes and the axis of rotation of the first roller as said looper means moves along said second path.

8. An apparatus as set forth in claim 7 wherein the portion of said second roller that engages said wires is located between said wires and a plane tangential to both said first and third rollers at their contact areas with said wires.

9. An apparatus as set forth in claim 9 wherein said means for rotating includes a guide roller frame upon which said second and third rollers are rotatably mounted, said guide roller frame being rotatable about the axis of rotation of the first roller, and means for rotating said guide roller frame about the axis of rotation of the first roller.

* * * * *